US011206955B2

(12) United States Patent
Smith

(10) Patent No.: US 11,206,955 B2
(45) Date of Patent: Dec. 28, 2021

(54) UPRIGHT STANDING TRAVEL SOAP DISH

(71) Applicant: Tijuana Smith, Hinsdale, IL (US)

(72) Inventor: Tijuana Smith, Hinsdale, IL (US)

(73) Assignee: Tijuana Smith, Hinsdale, IL (US)

( * ) Notice: Subject to any disclaimer, the term of this patent is extended or adjusted under 35 U.S.C. 154(b) by 0 days.

(21) Appl. No.: 15/679,843

(22) Filed: Aug. 17, 2017

(65) Prior Publication Data

US 2018/0049600 A1 Feb. 22, 2018

Related U.S. Application Data

(60) Provisional application No. 62/376,115, filed on Aug. 17, 2016.

(51) Int. Cl.
*A47K 5/05* (2006.01)
*A47K 5/02* (2006.01)

(52) U.S. Cl.
CPC . *A47K 5/05* (2013.01); *A47K 5/02* (2013.01)

(58) Field of Classification Search
CPC ..... A47K 5/08; A47K 5/02; A47K 5/05
USPC ..... 206/77.1; 248/206.2; 4/628
See application file for complete search history.

(56) References Cited

U.S. PATENT DOCUMENTS 3,899,073 A * 8/1975 Barr ..... A47K 5/03 206/77.1
4,344,529 A * 8/1982 Ibarzabal ..... A47K 5/02 206/77.1
D283,576 S * 4/1986 Lambert ..... D6/540
4,934,640 A * 6/1990 Bichon ..... A47K 5/02 206/77.1
5,894,931 A * 4/1999 Dunn ..... A47F 7/141 206/555
5,941,376 A * 8/1999 Liggett ..... A47K 5/02 206/550
6,206,186 B1 * 3/2001 Cerda-Vilaplana ..... G11B 33/0427 206/308.1
D553,820 S * 10/2007 Baumgart ..... D32/58
7,726,471 B2 * 6/2010 Srungaram ..... A47K 5/03 206/77.1
8,585,162 B2 * 11/2013 Pantoja ..... A47B 81/00 312/242
2004/0187264 A1 * 9/2004 Chuang ..... E05D 5/125 16/380

* cited by examiner

*Primary Examiner* — Anthony D Stashick
*Assistant Examiner* — Raven Collins

(57) ABSTRACT

The present invention comprises an upright standing soap hosting device with a holder/brackets for soap that rest on and allows the soap to stand and never touch the bottom of the soap dish/case. The hosting device is configured in different sizes to accommodate different shapes and molds of soap.

20 Claims, 7 Drawing Sheets

UPRIGHT STANDING TRAVEL SOAP DISH

FIELD OF THE INVENTION

The present invention relates to soap travel cases used to hold soap in between uses by the end user. More specifically, the invention relates to an upright standing soap holding device that fits into a soap travel case made to fit various soap sizes but particularly designed to fit various soaps that are larger than and shaped differently than soaps sold in department stores while also meeting the needs of regular shaped soaps. The design of the upright standing soap travel dish also provides adequate air that is needed to the life of a bar of soap.

BACKGROUND

With the increase among consumers for natural products, handmade soap makers are experiencing an increase in demand for their products. Seeing that handmade soaps are not sold in grocery store chains or department stores, packing options are limited and which has created a challenge for finding the right packaging or storage for handmade soap products.

Handmade soap makers have either resorted to making their own packaging or just wrapping it in regular paper. In addition to that, the soap doesn't fit very well into the traditional soap cases/dishes sold in stores. They are either stored in loofah soap pouches or wrapped up in paper or plastic. This decreases the amount of uses a customer will get out of that soap because the soap needs air to keep it from dissolving or melting away. Soap cases/dishes on the market are made to have the soap lay on the dish so in between washes, the water drains from the soap and the soap is laying in the bacteria from the water and it is dissolving from the water it is laying in. None of the soap cases provide a way for the soap to be able to stand instead of lay on the dish and none of them have anything that prevents the soap for touching the bottom of the dish holder.

Therefore, a need exist in the field for a hosting apparatus that handmade soap will fit into and position the soap to be in a standing instead of laying position on a dish shaped with an oval bottom so that the soap never touches the bottom of the dish where the water from use of the soap drains into. Finally, there is also a need for the configuration of additional apparatuses to accommodate the dimensions of other soap molds and sizes.

BRIEF SUMMARY OF THE INVENTION

The present invention comprises an upright standing hosting device with a holder/brackets for soap to rest on and allows the soap to stand and never touch the bottom of the soap case. The hosting device is configured in different sizes to accommodate different shapes and molds of soap.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any or all combinations of one or more of the associated listed terms. As used herein, the singular forms "a," "an," and "the" are intended to include the plural forms as well as the singular forms, unless the context clearly indicates otherwise. It will be further understood the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New soap hosting devices, apparatuses, and methods for positioning soap in a standing position on top of a dish are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by referencing the appended figures representing preferred embodiments.

Figure 1:
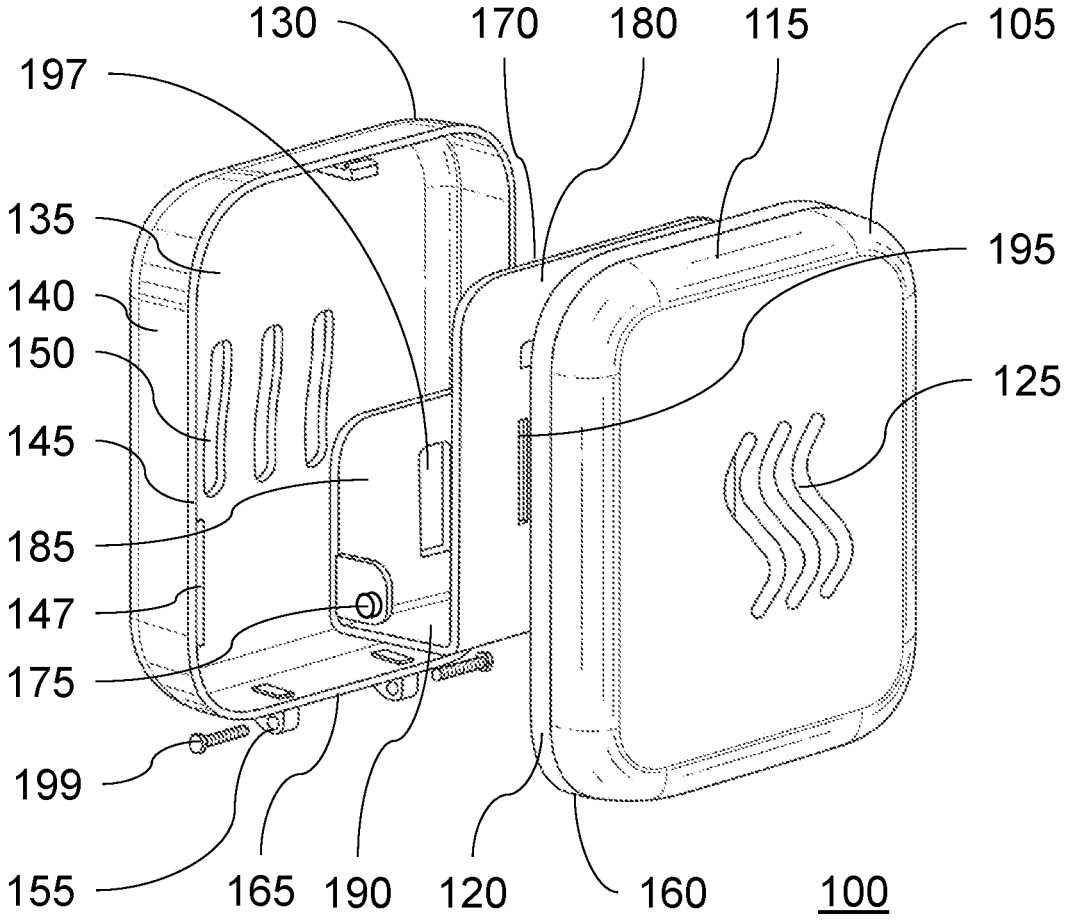
FIG. 1 illustrates blown-up view an upright soap case.

FIG. 1 illustrates blown-up view of an upright soap case 100 that keeps a soap bar dry in a closed configuration. The upright soap case 100 has a front case 105 and a back case 130 that encloses a holster 170, which may hold the soap bar.

The front case 105 has a front surface 110 and front edge walls 115 that have front edges 120. The front surface 110 of the front case 105 is illustrated with at least one front opening 125. A first front edge 160 of the front case 105 is hinged to a first back edge 165 of the back case 130 with help of a first hinge 155 using a screw 199.

The back case 130 has a back surface 135 and back edge walls 140 having back edges 145. The back case 130 is illustrated with at least one back opening 150 and with inner protrusion holders 147.

The holster 170 is hinged to the back case 130 through a second hinge located on the back case 130. The holster 170 has a top front holster surface 180 parallel to a back holster surface 185 and a soap rest surface 190 that connects the top front holster surface 180 and the hack holster surface 185. The top front holster surface 180 is illustrated with at least one front holster opening 195 and the back holster surface 185 is illustrated with at least one back holster opening 197 in the closed configuration of the upright soap case 100.

In the closed configuration, the front surface 110 of the front case 105, the back surface 135 of the back case 130, the front holster surface 180 and the back holster surface 185 are parallel.

Figure 2:
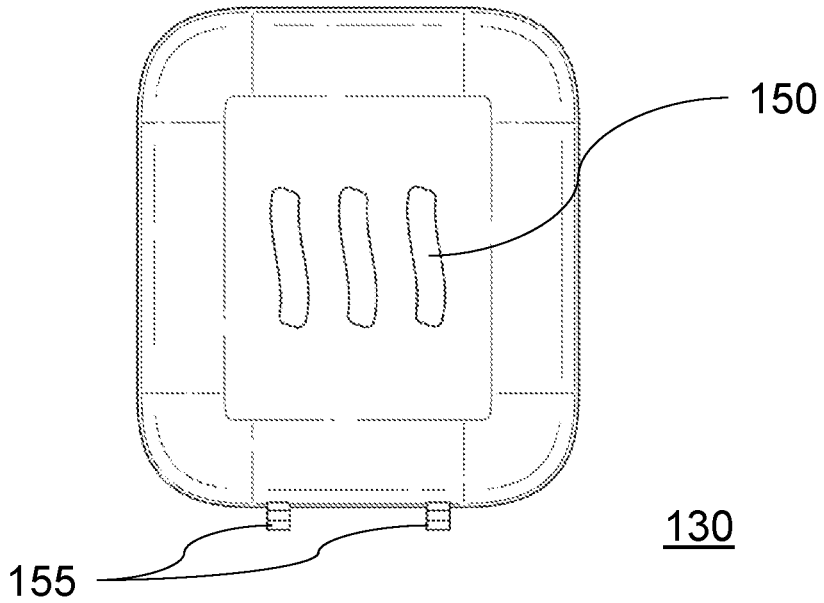
FIG. 2 illustrates a back view of a back case.

FIG. 2 illustrates a back view of the back case 130 is illustrated with at least one back opening 150 and the first hinge 155. The at least one back opening 150 is shown to be three curved-shaped openings.

Figure 3:
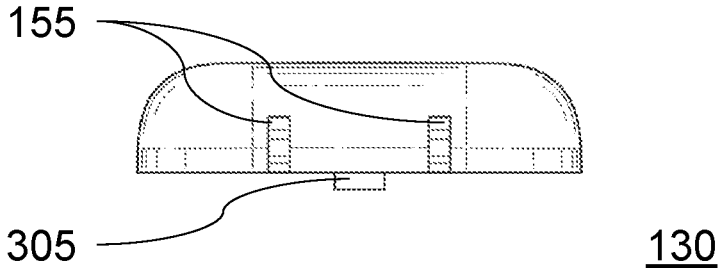
FIG. 3 illustrates a bottom view of the back case.

FIG. 3 illustrates a bottom view of the back case 130 that has the first hinge 155 and a clasp 305. The first hinge 155 allows relative rotational motion between the front case 105 and the back case 130, between the closed configuration to an open configuration of the upright soap case 100. In the closed configuration, the clasp 305 holds the front case 105 and the back case 130 together, preventing relative motion between them till a predefined force is applied. Application of force that is more than the predefined force, allows relative motion between the front case 105 and the back case 130 leading to the upright soap case 100 switching to the open configuration. In the open configuration, the holster 170 can accept a soap bar.

Figure 4:
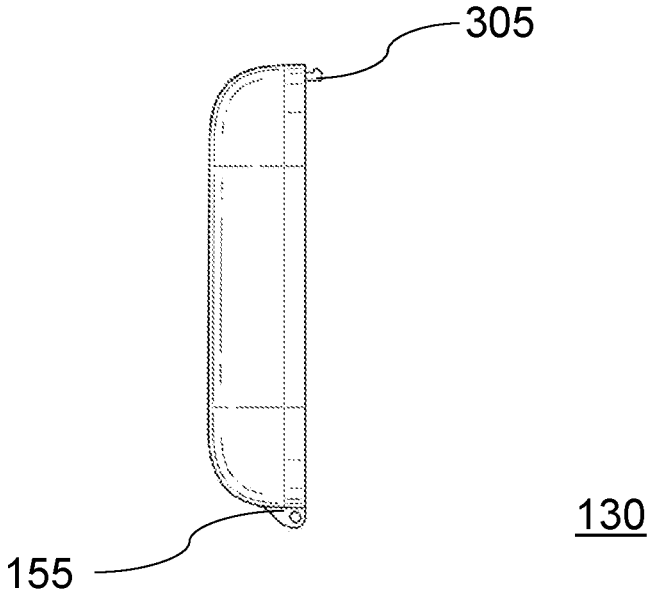
FIG. 4 illustrates a left side view of the back case.

FIG. 4 illustrates a left side view of the back case 130 that has the first hinge 155 and the clasp 305. The clasp 305 has a notch. The clasp 305 is at the edge opposite to that of the first hinge 155. The notch can engage with a mating portion, locking the upright soap case 100 in the closed configuration.

Figure 5:
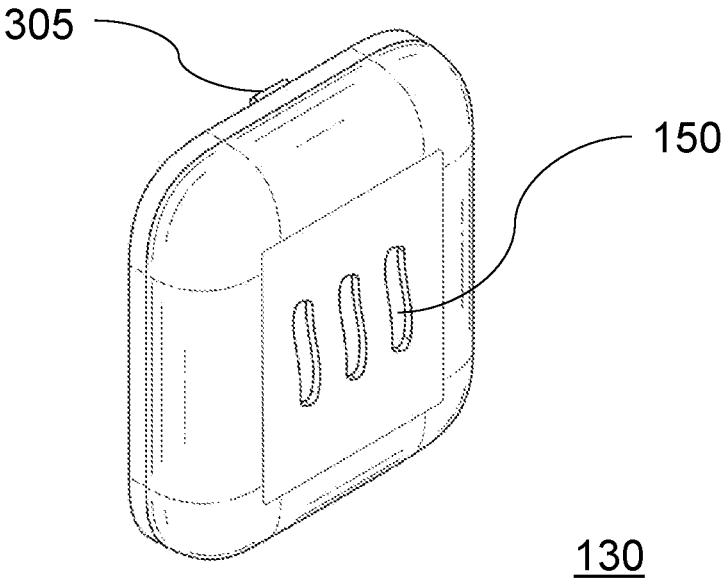
FIG. 5 illustrates an isometric view of the back case.

FIG. 5 illustrates an isometric view of the back case 130 showing the at least one bottom opening 150 and the clasp 305.

Figure 6:
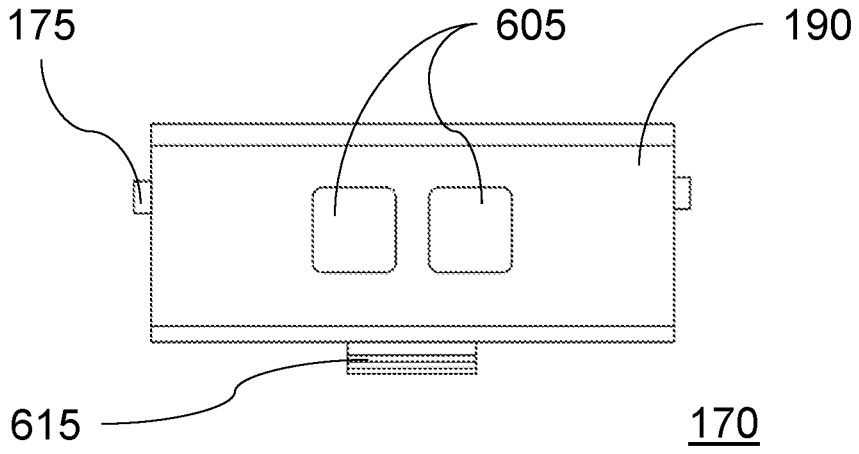
FIG. 6 illustrates a bottom view of a holster.

FIG. 6 illustrates a bottom view of the holster 170 that has a soap rest surface 190 illustrated with at least one soap rest opening 605, which are illustrated as two rectangular shaped openings. Moreover, the holster 170 has protruded pins 175 that engages with inner protrusion holders 147, allowing the holster 170 to rotate on the second hinge, when the upright soap case 100 is in the open configuration.

Figure 7:
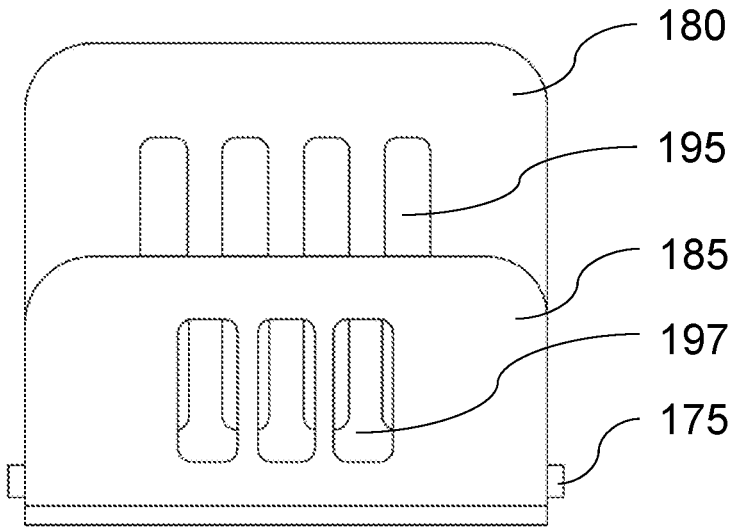
FIG. 7 illustrates a back view of the holster.

FIG. 7 illustrates a back view of the holster 170 showing the front holster surface 180 with at least one front holster opening 195 and the back holster surface 185 having at least one back holster openings 197.

Figure 8:
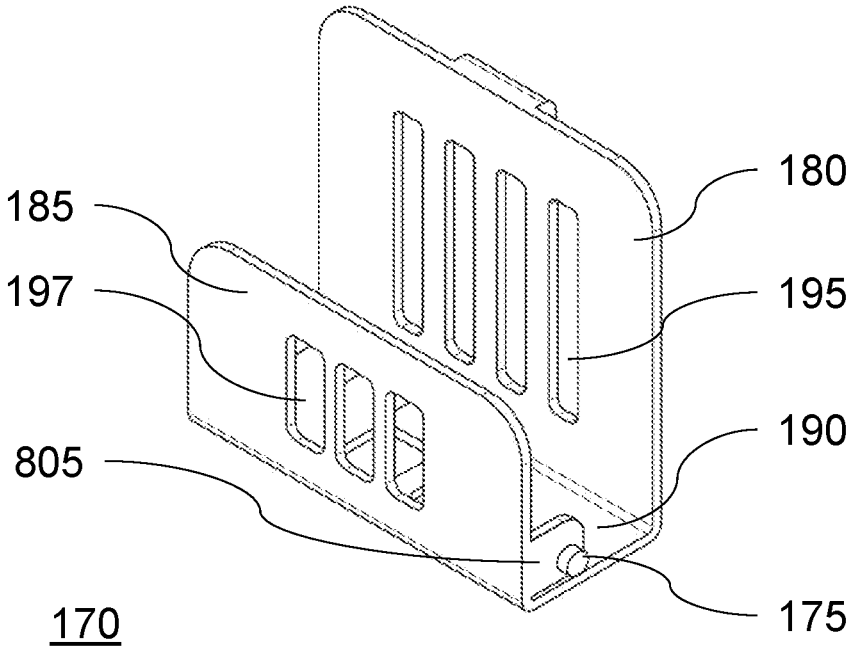
FIG. 8 illustrates an isometric view of the holster.

FIG. 8 illustrates an isometric view of the holster 170 having the front holster surface 180 parallel to the back holster surface 185 connected by the soap rest surface 190.

The at least one front opening 125, the at least one back opening 150, the at least one front holster opening 195, the at least one bottom holster openings 197, and, the at least one soap rest opening 605 allows water in the upright soap case 100 to drip off the soap and allows for air flow in the upright soap case 100 to dry the bar of soap and help extend the life of the soap.

The holster 170 also has the protruded pins 175 that engages with inner protrusion holders 147 of the bottom case 130.

Figure 9:
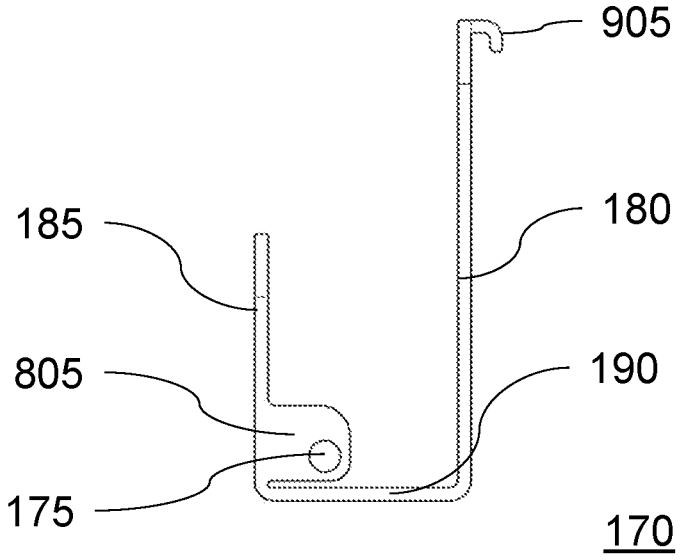
FIG. 9 illustrates a left side view of the holster.

FIG. 9 illustrates a left side view of the holster 170 that has the front holster surface 180 and the back holster surface 185 connected by the soap rest surface 190. The front holster surface 180 has a hook 905 at its top end that enables application of pull force, causing rotation of the holster 170 on the second hinge. The second hinge is parallel to the first hinge 155 and is on the same end of the back case 130 as the first hinge 155.

Figure 10:
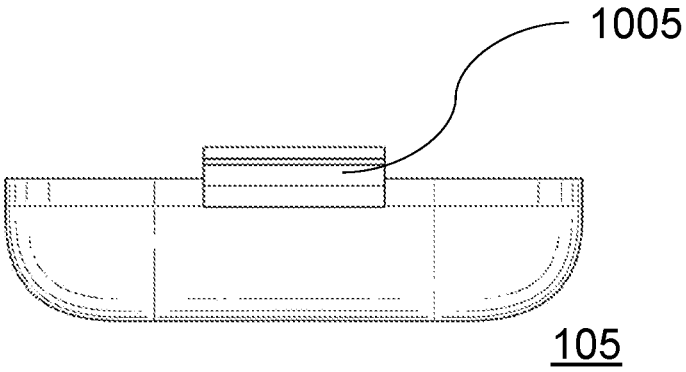
FIG. 10 illustrates a bottom view of a front case.

FIG. 10 illustrates a bottom view of the front case 105 that has a first hinge mating portion 1005 that engages with the first hinge 155, allowing relative rotation between the front case 105 and the back case 130. The first hinge mating portion 1005 is engaged with the first hinge 155 by the screw 199.

Figure 11:
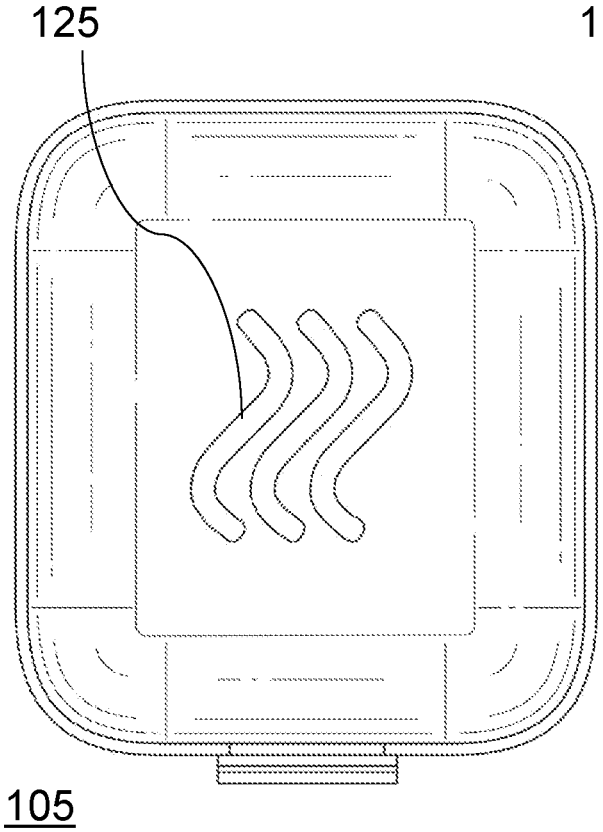
FIG. 11 illustrates a front view of the front case.

FIG. 11 illustrates a front view of the front case 105 showing the at least one top opening 125.

Figure 12:
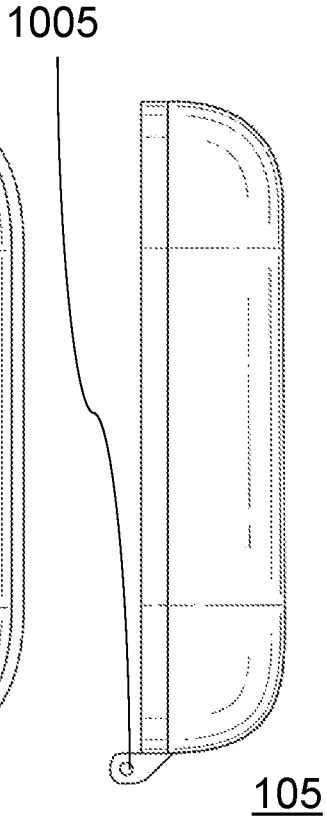
FIG. 12 illustrates a left side view of the front case.

FIG. 12 illustrates a left side view of the front case 105 showing the first hinge mating portion 1005.

Figure 13:
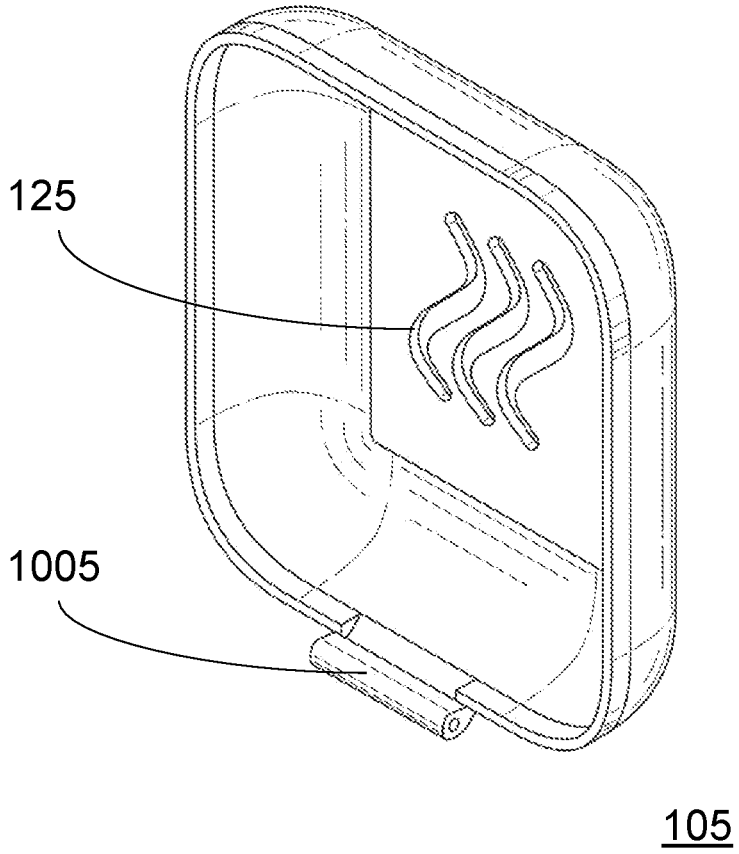
FIG. 13 illustrates an isometric view of the front case.

FIG. 13 illustrates an isometric view of the front case 105 having the first hinge mating portion 1005. The first hinge mating portion 1005 has a hole, that allows the screw 199 to engage the first hinge mating portion 1005 on the front case 105 to the first hinge 155 on the back case 130. This allows rotational motion between the front case 105 and the back case 130 allowing switching of the soap case 100 between the open configuration and the closed configuration.

While preferred materials for elements have been described, the device is not limited by these materials. Wood, plastics, rubber, foam, metal alloys, aluminum, and other materials may comprise some or all of the elements of the soap hosting dish/case positioning devices and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An upright standing soap travel case comprising:

a front case having a front surface and front edge walls having front edges, the front surface has at least one front opening:

a back case having a back surface and back edge walls having back edges, the back surface has at least one opening, the back case and the front case are hinged at a first hinge, the first hinge is at a first front edge of the front case and a first bottom back edge of the bottom back case; and a holster capable of holding a soap bar, the holster is hinged to the back case through a second hinge portion located on the back case, the holster having a front holster surface parallel to a back holster surface and a soap rest surface connecting the front holster surface and the back holster surface, where the soap rest surface is near a second hinge portion located on the holster, the front holster surface having at least one front holster opening and the back holster surface having at least one back holster opening, where in a closed configuration, the front surface of the front case is parallel to the back surface of the back case and the holster is enclosed by the front case and back case.

2. The upright standing soap travel case of claim 1 where the second hinge is parallel to the first hinge.

3. The upright standing soap travel case of claim 1 where the second hinge is on the same end of the back case as the first hinge.

4. The upright standing soap travel case of claim 1 where the at least one back opening and the at least one front opening are curved-shaped.

5. The upright standing soap travel case of claim 1 where the at least one front holster opening is rectangular with curved corners.

6. The upright standing soap travel case of claim 1 further comprising a locking mechanism on edges opposite to the first front edge and the first back edge.

7. The upright standing soap travel case of claim 1 where, in the closed configuration, the front holster surface is parallel to the back surface of the back case.

8. The upright standing soap travel case of claim 1 where, in the closed configuration, the front holster surface is spaced apart from the front surface of the front case and the back holster surface is spaced apart from the back surface of the back case.

9. The upright standing soap travel case of claim 1 where the soap rest surface has at least one soap rest opening.

10. The upright standing soap travel case of claim 9 where the at least one soap rest openings is rectangular or square shaped.

11. The upright standing soap travel case of claim 1 where the at least one front holster opening further comprising at least two front holster openings on the front holster surface and the at least one back holster opening, further comprising at least two back holster openings on the back holster surface.

12. The upright standing soap travel case of claim 1 where the holster further comprises side wall portions having protruded pins for the second hinge.

13. The upright standing soap travel case of claim 12 where the back case has inner protrusion holders to hold the protruded pins of the holster.

14. The upright standing soap travel case of claim 1 where height of the front holster surface is more than the back holster surface.

15. The upright standing soap travel case of claim 1 where the holster further comprising a hook that enables application of pull force that causes rotation of the holster on the second hinge.

16. The upright standing soap travel case of claim 1 where the first front edge of the front case has two spaced apart screw holders and the first back edge of the back case has a mating screw holder that allow a screw to rotatably engaged with the screw holders, forming the first hinge.

17. The upright standing soap travel case of claim 1 when in the closed configuration where the soap case is configured to stand with the first back edge on a surface.

18. The upright standing soap travel case of claim 3 when in the closed configuration where the soap case is configured to stand with the first back edge on a surface.

19. An upright standing soap travel case comprising:

a front case having a front surface and front edge walls has front edges, the front surface has at least one front opening, where the at least one front opening is curved-shaped:

a back case having a back surface and back edge walls having back edges, the back surface has at least one back opening, the back case and the front case are hinged at a first hinge, the first hinge is at a first front edge of the front case and a first back edge of the back case; and a holster capable of holding a soap bar, the holster is hinged to the back case through a second hinge portion located on the back case;

the holster having a front holster surface parallel to a back holster surface and a soap rest surface connecting the front holster surface and the back holster surface, where the soap rest surface is near a second hinge portion located on the holster, the front holster surface having at least one front holster opening and the back holster surface having at least one back holster opening, where in a closed configuration, the front surface of the front case is parallel to the back surface of the back case and the holster is enclosed by the front case and back case, where the holster further comprising side wall portions having protruded pins for the second hinge, and where the back case has inner protrusion holders to hold the protruded pins of the holster.

20. An upright standing soap travel case comprising:

a front case having a front surface and front edge walls having front edges, the front surface has at least one front opening, where the at least one front opening is curved-shaped:

a back case having a back surface and back edge walls having back edges, the back surface has at least one back opening, the back case and the front case are hinged at a first hinge, the first hinge is at a first front edge of the front case and a first back edge of the back case; and a holster capable of holding a soap bar, the holster is hinged to the back case through a second hinge portion located on the back case, the holster having a front holster surface parallel to a back holster surface and a soap rest surface connecting the front holster surface and the back holster surface, where the soap rest surface is near a second hinge portion located on the holster, the front holster surface having at least one front holster opening and the back holster surface having at least one back holster opening, where in a closed configuration, the front surface of the front case is parallel to the back surface of the back case and the holster is enclosed by the front case and back case, where the first front edge of the front case has two spaced apart screw holders and the first back edge of the back case has a mating screw holder that allows a screw to rotatably engage with the screw holders, forming the first hinge.

* * * * *